US005377727A

United States Patent [19]

Ueda et al.

[11] Patent Number: 5,377,727

[45] Date of Patent: Jan. 3, 1995

[54] APPARATUS FOR MEASURING OUT AND FILLING PARTICULATE OR GRANULAR MATERIAL

[75] Inventors: Michio Ueda; Tetsuya Iuchi; Takao Miki; Hisanori Hamada, all of Tokushima, Japan

[73] Assignee: Shikoku Kakoki Co., Ltd., Takushima, Japan

[21] Appl. No.: 133,257

[22] Filed: Oct. 8, 1993

[30] Foreign Application Priority Data

Oct. 8, 1992 [JP] Japan ..... 4-70226

[51] Int. Cl.[6] ..... B65B 43/00

[52] U.S. Cl. ..... 141/178; 141/237; 141/241; 222/308

[58] Field of Search ..... 141/178, 179, 237, 238, 141/241, 234, 236–245; 222/305–308

[56] References Cited

U.S. PATENT DOCUMENTS

| | | | |
|---|---|---|---|
| 733,682 | 7/1903 | Smith | 141/178 X |
| 1,092,565 | 4/1914 | Dix | 141/239 |
| 2,024,130 | 12/1935 | Kronbach | 141/239 X |
| 4,232,717 | 11/1980 | Allgaier et al. | 141/179 |
| 4,877,067 | 10/1989 | Shimokawa et al. | 141/178 X |

FOREIGN PATENT DOCUMENTS

| | | | |
|---|---|---|---|
| 0326064 | 9/1919 | Germany | 141/244 |
| 0293338 | 7/1928 | United Kingdom | 141/237 |
| 0437690 | 11/1935 | United Kingdom | 141/178 |

*Primary Examiner*—J. Casimer Jacyna

*Attorney, Agent, or Firm*—Armstrong, Westerman, Hattori, McLeland & Naughton

[57] ABSTRACT

An apparatus for measuring out and filling a particulate or granular material comprises an intermittently drivable container conveyor extending through a filling station for a plurality of containers as arranged in a feed direction to be fed to and stopped at the filling station at a time by the operation of the conveyor, a horizontal feed roller disposed at the filling station and extending across the path of transport by the conveyor thereabove, the feed roller being formed in its outer surface with measuring pockets spaced axially of the roller and equal in number to the number of containers stopped at the filling station, a particulate or granular material hopper disposed above the feed roller, and a filling chute disposed between the conveyor and the feed roller. The chute has a plurality of upward inlets arranged axially of the roller so as to communicate with the respective pockets when the pockets are directed downward and a plurality of downward outlets arranged along the transport path so as to be opposed from above to the respective containers stopped at the filling station.

5 Claims, 2 Drawing Sheets

APPARATUS FOR MEASURING OUT AND FILLING PARTICULATE OR GRANULAR MATERIAL

BACKGROUND OF THE INVENTION

The present invention relates to an apparatus for measuring out and filling a particulate or granular material, such as an ingredient of precooked noodles, into cups or containers.

Apparatus of the type mentioned are already known which comprise an intermittently drivable container conveyor extending through a filling station, a horizontal feed roller disposed at the filling station and extending across the conveyor transport path thereabove, a particulate or granular material hopper disposed above the feed roller, and a filling chute provided between the conveyor and the feed roller.

When it is desired to double the filling capacity of the above apparatus, it appears feasible to double the distance the conveyor is driven at a time for feeding and feed two containers at a time. The apparatus then needs to have two units of each of the feed roller, material hopper and filling chute, whereas this doubles the installation space and equipment cost and is not economical.

SUMMARY OF THE INVENTION

An object of the present invention is to provide an apparatus for measuring out and filling a particulate or granular material which apparatus is given an improved filling capacity with minimized increases in the installation space and equipment cost.

The present invention provides an apparatus for measuring out and filling a particulate or granular material which comprises an intermittently drivable container conveyor extending through a filling station for a plurality of containers as arranged in a feed direction to be fed to and stopped at the filling station at a time by the operation of the conveyor, a horizontal feed roller disposed at the filling station and extending across the path of transport by the conveyor thereabove, the feed roller being formed in its outer surface with measuring pockets spaced axially of the roller and equal in number to the number of containers stopped at the filling station, a particulate or granular material hopper disposed above the feed roller, and a filling chute disposed between the conveyor and the feed roller, the feed chute having a plurality of upward inlets arranged axially of the roller so as to communicate with the respective measuring pockets when the pockets are directed downward and a plurality of downward outlets arranged in the direction of the conveyor transport path so as to be opposed from above to the respective containers stopped at the filling station.

With the apparatus of the present invention, a plurality of containers as arranged in a feed direction are fed to and stopped at the filling station at a time by the operation of the conveyor. The feed roller is formed in its outer surface with measuring pockets spaced axially of the roller and equal in number to the number of containers as stopped at the filling station. The filling chute has a plurality of upward outlets adapted to communicate with the respective measuring pockets are directed downward and a plurality of downward outlets adapted to be opposed from above to the respective containers as stopped at the filling station. The particulate or granular material is placed into the measuring pockets. When the measuring pockets are directed downward by the rotation of the feed roller, the material is placed into the filling chute inlets from the respective pockets, falls through the chute, is discharged from the chute outlets and is filled into the plurality of containers as transported to and stopped at the filling station by the conveyor.

According to the present invention, therefore, the apparatus need not have two units of each of the feed roller, material hopper and filling chute but is increased merely in the number of measuring pockets and the number of inlets and outlets of the chute which is branched, whereby the apparatus is given an improved filling capacity with minimized increases in the installation space and equipment cost.

DESCRIPTION OP THE PREFERRED EMBODIMENT

An embodiment of the invention will be described next with reference to the drawings.

Figure 1:
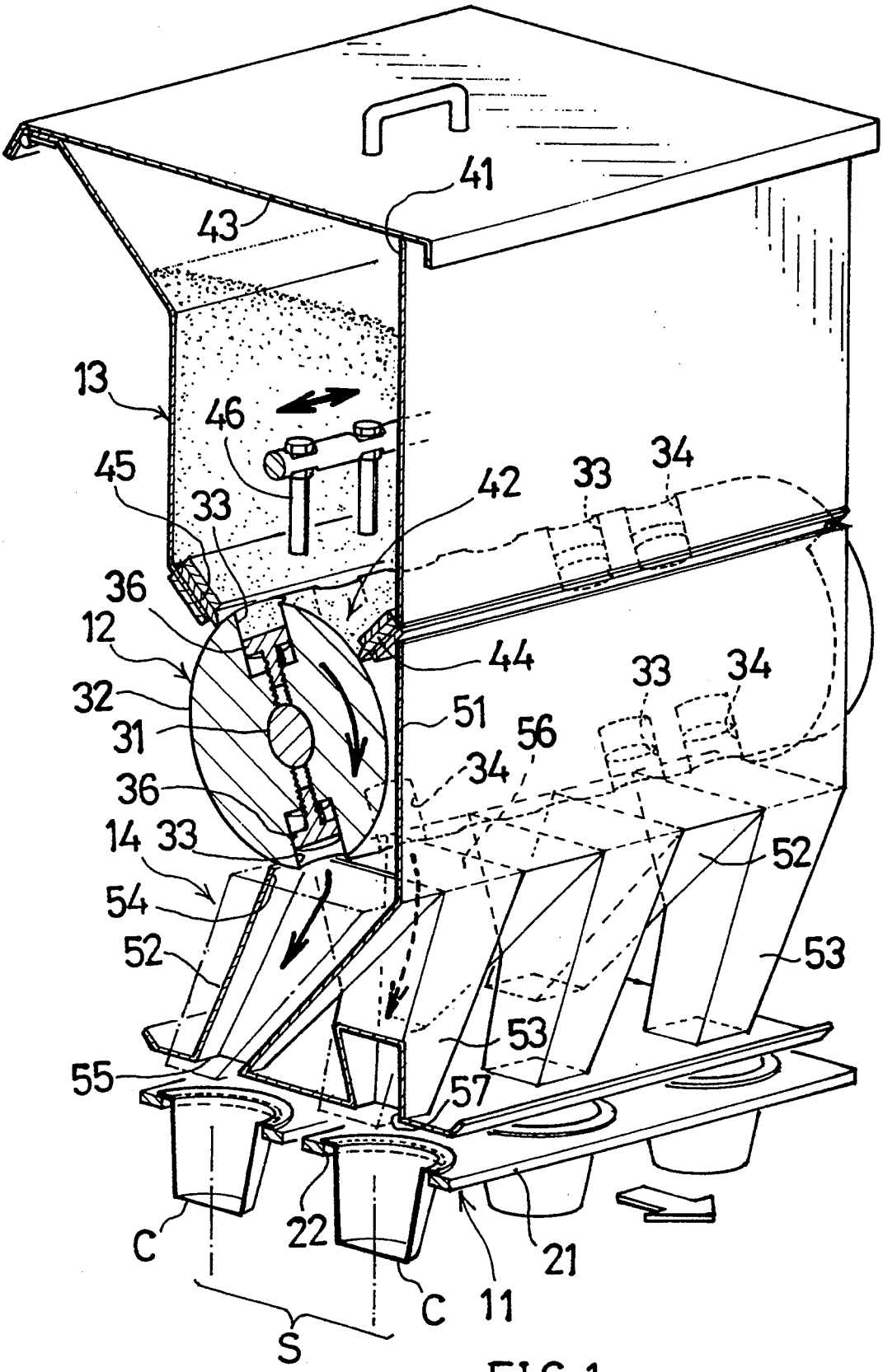
FIG. 1 is a perspective view partly broken away and showing an apparatus of the invention.
Figure 2:
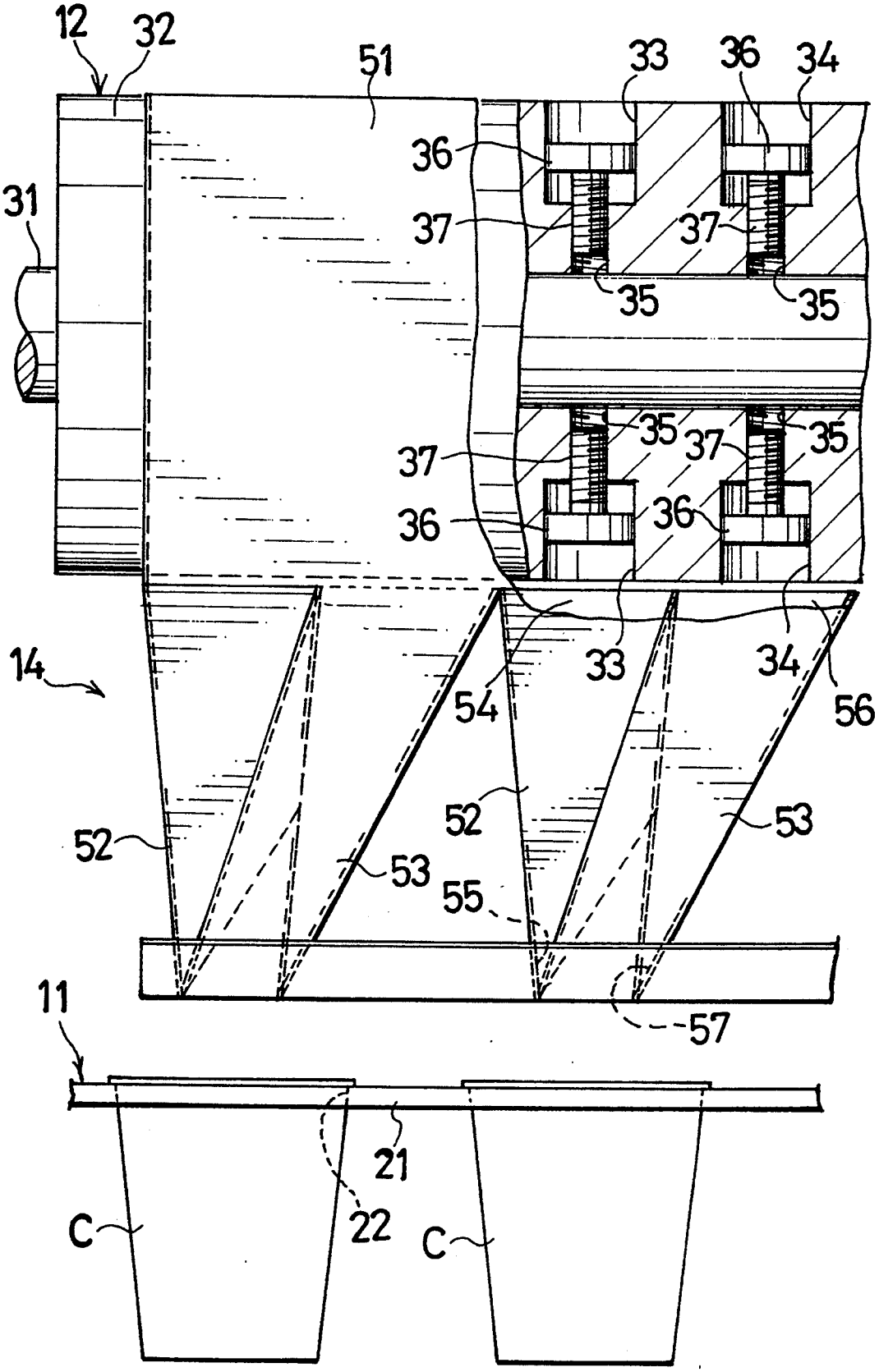
FIG. 2 is a view partly in vertical section and showing the apparatus.

In the following description, the term "front" refers to the direction toward which containers are transported by the conveyor (i.e., the direction of large arrow in FIG. 1), the term "rear" to the direction opposite to the above, and the terms "right" and "left" are used as the apparatus is viewed from the front rearward.

The illustrated apparatus for measuring out and filling a particulate or granular material comprises an intermittently drivable container conveyor 11 extending forward through a filling station S, a horizontal feed roller 12 disposed at the filling station S and extending across the path of transport by the conveyor thereabove, a particulate or granular material hopper 13 disposed above the feed roller 12, and a filling chute 14 provided between the conveyor 11 and the feed roller 12.

The container conveyor 11, which is a slat conveyor having a plurality of transport paths, is intermittently driven so as to successively stop two slats 21 at a time at the filling station S. Each of the slats 21 is formed with container holding apertures 22 equal in number to the number of container transport paths and arranged at a spacing longitudinally of the slat.

The feed roller 12 comprises a horizontal rotary shaft 31, and a synthetic resin drum 32 fitting around the shaft. The drum 32 has right and left measuring pockets 33, 34 in two pairs which are circumferentially spaced apart by 180 degrees about the center of the drum and formed in the drum outer surface for each container transport path, each pair of pockets 33, 34 being spaced axially of the drum. Each of the pockets 33, 34 has a threaded bore 35 in its bottom. A filling amount adjusting member 36 is inserted in the pocket at an adjustable depth. The adjusting member 36 has an inwardly projecting screw rod 37 screwed into the threaded bore 35.

The particulate or granular material hopper 13 is in the form of a box having a width approximately equal to the length of the feed roller 12, and has an upper end providing an upward inlet 41 and a lower end providing a downward outlet 42. The inlet 41 is covered with a closure 43. The outlet 42 has front and rear scrapers 44, 45 of synthetic resin attached to its front and rear edges, respectively, at an adjustable level. Each of the scrapers has a forward end in contact with the outer periphery of the feed roller 12. A blocking preventing agitating bar 46 is provided inside the hopper 13 at a lower portion thereof.

The filling chute 14 comprises an upper chute body 51 covering the front lower half portion of the feed roller 12 and having a width approximately equal to the length of the feed roller 12, and right and left branched chuter members 53, 52 integral with the lower portion of the chute body 51 and provided in pairs for the respective container transport paths. The left chute member 52 of each pair has an inlet 54 which is positioned to communicate with the left measuring pockets 33 of the corresponding two pairs of measuring pockets 33, 34, and an outlet 55 so positioned as to be opposed from above to the rear container C of two containers C in the corresponding transport path which are stopped at the filling station S. On the other hand, the right chute member 53 of each pair has inlet 56 which is positioned to communicate with the right measuring pockets 34 of the corresponding two pairs of measuring pockets 33, 34, and an outlet 57 so positioned as to be opposed from above to the front container C of two containers C in the corresponding path.

A particulate or granular material is contained in the hopper 13. The feed roller 12 is driven clockwise as indicated by an arrow in FIG. 1 intermittently by 180 degrees at a time. While the measuring pockets 33, 34 as directed upward move past the outlet 42 of the hopper 13, the material is placed into the pockets 33, 34. Before the upward pockets 33, 34 are oriented downward, two containers C in each transport path are fed to and stopped at the filling station S. Upon the pockets 33, 34 reaching the position where they are directed downward, the material in the pockets 33, 34 is delivered into the inlets 53, 54 of the branched chute members 52, 53. The portions of the material separately falling through the chute members 52, 53 are placed into and fill the respective containers C waiting therebelow.

What is claimed is:

1. An apparatus for measuring out and filling a particulate or granular material comprising:

an intermittently drivable container conveyor extending through a filling station for a plurality of containers as arranged in a feed direction to be fed and stopped at the filling station at a time by the operation of the conveyor, a horizontal feed roller disposed at the filling station and extending across the path of transport by the conveyor thereabove, the feed roller being formed in its outer surface with measuring pockets spaced axially of the roller and equal in number to the number of containers stopped at the filling station, a particulate or granular material hopper disposed above the feed roller, and a filling chute disposed between the conveyor and the feed roller, the filling chute having a plurality of upward inlets arranged axially of the roller in a direction perpendicular to the direction of the transport path so as to communicate with the respective measuring pockets when the pockets are directed downward and a plurality of downward outlets arranged parallel to the direction of the conveyor transport path so as to be opposed from above to the respective containers stopped at the station.

2. An apparatus for measuring out and filling a particulate or granular material comprising:

an intermittently drivable container conveyor having a plurality of transport paths extending through a filling station for a plurality of containers as arranged in a feed direction in each of the transport paths to be fed to and stopped at the filling station at a time by the operation of the conveyor, a horizontal feed roller disposed at the filling station and extending across the transport paths thereabove, the feed roller having measuring pockets formed in its outer surface for each transport path, the measuring pockets being spaced axially of the roller and equal in number to the number of containers stopped at the filling station, a particulate or granular material hopper disposed above the feed roller, and a filling chute disposed between the conveyor and the feed roller, the filling chute having a plurality of upward inlets arranged axially of the roller in a direction perpendicular to the transport paths so as to communicate with the respective measuring pockets when the pockets are directed downward and a plurality of downward outlets arranged parallel to the direction of the transport paths so as to be opposed from above to the respective containers stopped at the filling station.

3. An apparatus as defined in claim 1 or 2 wherein the measuring pockets spaced axially of the roller are formed in each of outer surface portions spaced apart circumferentially of the roller by 180 degrees.

4. An apparatus as defined in claim 1 or 2 wherein each of the measuring pockets has a filling amount adjusting member inserted therein at an adjustable depth.

5. An apparatus as defined in claim 4 wherein each of the measuring pockets has a threaded bore in its bottom, and the filling amount adjusting member has a screw rod screwed into the bore.

* * * * *